United States Patent [19]

Adams

[11] Patent Number: 4,829,612

[45] Date of Patent: May 16, 1989

[54] PATIENT TRANSFER APPARATUS

[76] Inventor: James A. Adams, 1811 N. Williams, Amarillo, Tex. 79107

[21] Appl. No.: 195,113

[22] Filed: May 16, 1988

[51] Int. Cl.[4] ..... A61G 7/10

[52] U.S. Cl. ..... 5/81 R; 272/146; 297/DIG. 10

[58] Field of Search ..... 5/81 R, 81 B, 445, 508, 5/503, 507; 414/921; 297/DIG. 10; 135/65; 272/146

[56] References Cited

U.S. PATENT DOCUMENTS

| | | | |
|---|---|---|---|
| 2,757,388 | 8/1956 | Chisholm | 5/507 |
| 2,963,713 | 12/1960 | Forrest | 5/81 R |
| 3,967,329 | 7/1976 | Whitton, Jr. et al. | 5/81 R |
| 4,279,043 | 7/1981 | Saunders | 5/81 R |
| 4,305,579 | 12/1981 | Rice | 272/146 |

*Primary Examiner*—Alexander Grosz
*Attorney, Agent, or Firm*—John S. Egbert

[57] ABSTRACT

A patient transfer apparatus comprising a lower platform, an upper platform, a mast, and a leg abutment member. The lower platform has a generally flat upper surface and a flat lower surface. The lower surface of the lower platform has a plurality of suction areas for engaging an abutting surface. The upper platform is rotatable relative to the lower platform and includes an elongated portion extending outwardly from a generally semi-circular portion of the upper platform. The mast extends upwardly perpendicular to the surface of the upper platform and is mounted to the top surface of the upper platform. The mast has a plurality of vertically spaced holes extending therethrough. The crossbar is adjustably connected to the mast and extends parallel to the upper platform. The crossbar includes a locking mechanism for fixing the crossbar an appropriate longitudinal distance from the upper platform. The leg abutment member includes first and second padded members affixed to the ends of the crossbar. These padded members include appropriate indentations for receiving the leg of a patient and for receiving the leg of a health care worker.

20 Claims, 6 Drawing Sheets

PATIENT TRANSFER APPARATUS

TECHNICAL FIELD

This invention relates to means for aiding health care workers to raise or lift invalid persons. More particularly, the present invention relates to devices for aiding a standing person to lift a seated person from a seated position to a standing position and for transferring such person to another location.

BACKGROUND ART

In hospitals, it is a difficult task for the health care worker to transfer the invalid patient from the wheelchair to a bed. In addition, it is often difficult to transfer such patient from the bed back to the wheelchair. In typical hospital operations, such tasks require the health care worker to bodily lift the patient from the sitting to standing position, and vice versa. This also requires the health care worker to uncomfortably twist so as to transfer the patient from one position to another position, such as from the wheelchair to the bed.

In the normal hospital environment, such operations require a relatively large or strong person to bodily lift the patient from one position to the other. This lifting can result in excess strain on the back of the health care worker aiding the patient to rise, especially since the helping person must bend forward into a position over the patient. Over the years, a large number of hospital-related injuries have occured from the strain and exertion caused by such tasks. When the person doing the lifting, such as a medical aid, therapists, nurse, etc., is small in size relative to the size of the patient, this problem is accentuated. Furthermore, the patient himself may have a strain placed on his or her body during these patient transfer operations.

There have been patents in the past that have attempted to address this problem. Two of these patents are U.S. Pat. No. 2,757,388, issued on Aug. 7, 1956, to E. Chisholm and U.S. Pat. No. 3,967,329, issued on July 6, 1976, to Whitton, Jr. et al.

U.S. Pat. No. 2,757,388 discloses a bedside transfer stand. This patented device is a turnstand that can be placed between a bed and a wheelchair. The patient may grasp the steadying rail, rise, stand, and be turned. After turning, the patient may sit down on a bed or a wheelchair. This device, however, is only appropriate for those patients that are able to stand on their own. It does not provide the proper knee restrain so as to allow the health care professional the proper leverage for pulling forward those patients that have insufficient strength to lift themselves.

U.S. Pat. No. 3,967,329 is an invalid lifting device which includes a portion that is fitted to the knee of the health care worker and another portion that serves to abut the knee of the invalid patient. This device provides the necessary knee restrain so as to allow the health care worker the proper leverage for pulling forward the invalid patient. Importantly, however, this does not offer turntable ability for the purpose of properly rotating the patient from a wheelchair to a bed.

It is an object of the present invention to provide a patient transfer apparatus, which allows a relatively small person to lift a larger person without excess strain.

It is another object of the present invention to provide a patient transfer apparatus that allows the patient to be moved from a wheelchair to an adjacent bed by turntable or rotation.

It is still another object of the present invention to provide a patient transfer apparatus to reduce the risk of injury to the health care professional during the transferring of invalid patients.

It is still another object of the present invention to provide a patient transfer apparatus that is mechanically simple and inexpensively manufactured.

These and other objects and advantages of the present invention will become apparent from a reading of the attached specification and appended claims.

DISCLOSURE OF THE INVENTION

The present invention is a patient transfer apparatus that comprises a lower platform, an upper platform, a mast, a crossbar, and leg abutment members. The upper platform is rotatable relative to the lower platform. The mast extends upwardly perpendicular to the upper surface of the upper platform. The crossbar is adjustably connected to the mast. The crossbar is parallel to the upper platform. The leg abutment member is fashioned generally at the end of the crossbar. This leg abutment member is for receiving the leg of a patient.

The lower platform has a generally flat upper surface and a flat lower surface. The lower platform has a surface area less than that of the surface of the upper platform. The lower platform has a plurality of suction areas formed thereon for engaging an abutting surface.

A plurality of Teflon gaskets are interposed between the lower platform and the upper platform. These Teflon gaskets allow the rotational movement of the upper platform relative to the lower platform.

The mast is a tubular member mounted at one end of the surface of the upper platform. The mast has a plurality of vertically spaced holes extending therethrough. The crossbar includes a cylindrical shaft having an inner diameter greater than the outer diameter of the tubular member, and a suitable mechanism for attaching the cylindrical shaft in fixed relation to the mast. The crossbar is fixedly attached to the exterior of the cylindrical shaft. The crossbar extends radially outwardly from the cylindrical shaft. A pin extends through the opening on the cylindrical shaft and engages the holes extending through the tubular member.

The leg abutment member comprises of a first padded member affixed at one end to the crossbar and a second padded member affixed to the other end of the crossbar. These first and second padded members receive the legs of the patient. Each of the first and second padded members includes the first indentation formed on one side of the padded member and second indentation formed on the other side of the padded member. The first indentation has a radius suitable for receiving the leg of the patient. The second indentation is appropriate for receiving the leg health care professional.

The present invention also includes the method of transferring a patient from the wheelchair to a bed by a health care professional. This method includes the steps of: (1) placing the feet of the invalid patient onto the upper surface of the rotatable table; (2) pulling the invalid patient forward until the knees of the patient abut a crossbar extending parallel to the rotatable table; (3) rotating the patient and the table until the back of the patient is adjacent to the bed; (4) releasing the patient such that the patient moves backward onto the bed. This method further includes the step of adjusting the crossbar to a distance generally corresponding to the location of the knee of the patient. The method includes the step of fastening the rotatable table to the floor between the wheelchair and the bed. Additionally, this method may include the step of placing the knees of the health care professional against the crossbar on the opposite side of the crossbar from the knee of the patient.

DETAILED DESCRIPTION OF THE INVENTION

Figure 1:
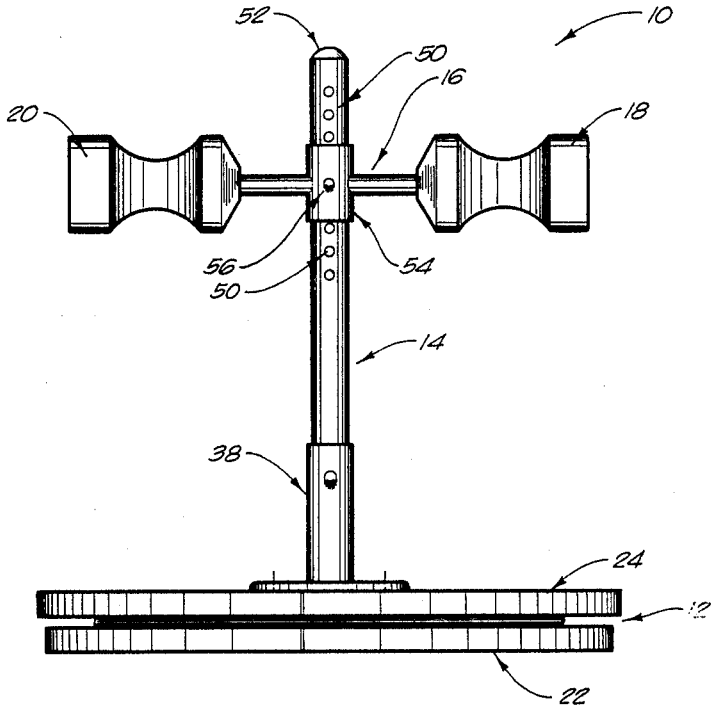
FIG. 1 shows a forward view of the patient transfer apparatus in accordance with the present invention.

Referring to FIG. 1, there is shown at 10 the patient transfer apparatus in accordance with the preferred embodiment of the present invention. As can be seen in FIG. 1, the patient transfer apparatus 10 includes a rotatable table 12, a mast 14, a crossbar 16, and leg abutment members 18 and 20. Each of these components combine to teach the patient transfer apparatus for the convenient transfer of invalid patients. The rotatable table 12 includes a lower platform 22 and an upper platform 24. The upper platform 24 is rotatable relative to the lower platform 22. The details of the rotatable table 12 are shown in exploded fashion in FIG. 6.

Figure 6:
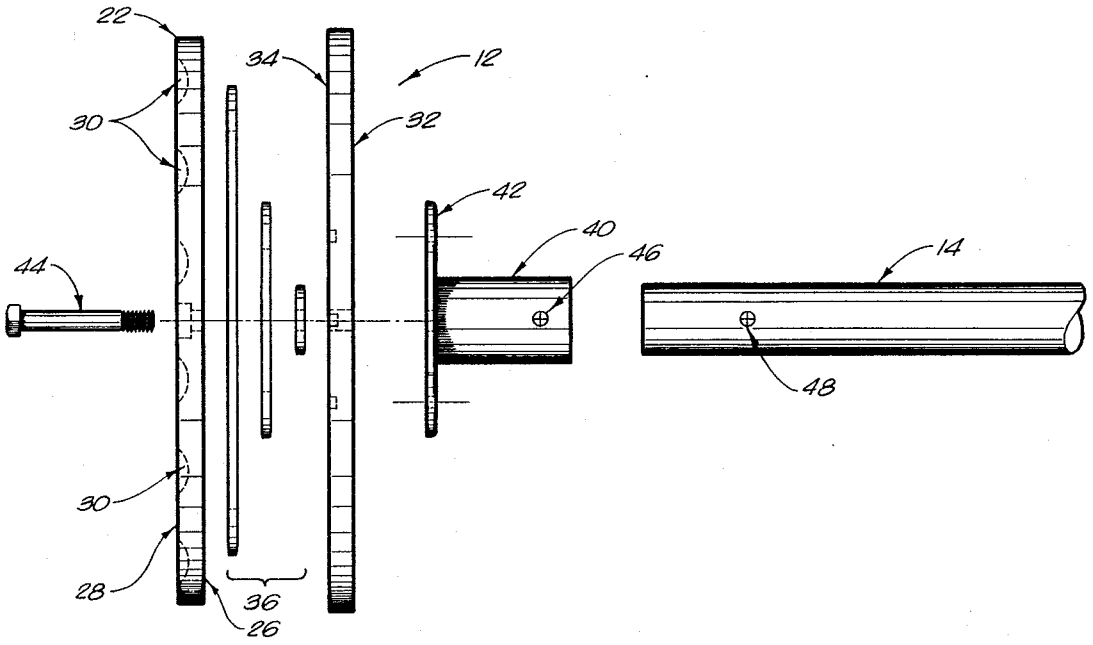
FIG. 6 is an exploded view showing the details of the configuration of the rotatable table and mast of the present invention.

Referring to FIG. 6, there is shown the rotatable table 12 and a portion of the mast 14. The upper platform 24 and the lower platform 22 are individually illustrated. It can be seen that the lower platform 22 has a generally flat upper surface 26 and a flat lower surface 28. It can be also seen that the lower platform 22 has a surface area somewhat less than the surface area of the upper platform 24. In FIG. 6, it can be seen that the flat lower surface 28 of the lower platform 22 has a plurality of suction areas 30 formed thereon. The suction areas 30 are arranged at the bottom of platform 22 so as to engage an abutting surface, such as a floor, for the stability of the operation of the patient transfer apparatus 10. Lower platform 22 may be made of plywood, or other material, and have a rubber-cupped non-slip bottom surface. Importantly, the material in the particular configuration of the bottom platform 22 is not considered to be an important limitation of the present invention.

Top platform 24 has a flat upper surface 32. As will be described hereinafter, the upper platform 24 has an elongated portion extending outwardly (although not shown in FIG. 6) from a generally semicircular portion of the upper platform 24. Platform 24 includes a Teflon sheeting bottom 34. The top portion 32 may also include a non-slip covering so as to afford better traction for the patient. Top platform 24 may also include a metal edge trim around the sides.

A plurality of Teflon gaskets 36 are interposed between the lower platform 22 and the upper platform 24. These Teflon gaskets 36 allow proper rotational movement between the upper and lower platforms. A mounting bracket is mounted to the top surface 32 of upper platform 24. In particular, this mounting bracket 38 is an aluminum shaft 40 that is welded to a large flat plate 42. Flat plate 42 may be bolted, threaded, welded, or otherwise attached to the center of the top surface 32 of upper platform 24. Bolt 44 is inserted into lower platform 22 through Teflon gaskets 36, through upper platform 24 and engages the mounting bracket 38. When tightened, each of these components combines to form the rotatable table 12 of the present invention. The mast 14 is shown, in the exploded view of FIG. 6, in suitable position for attachment by rivets, pins, or bolts through the corresponding holes 46 of the mounting bracket 38 and the holes 48 at the bottom of the mast 14. Ideally, the mast 14 is removably inserted into the mounting bracket 38 so as to permit the present invention to be easily stored, assembled, shipped, and packaged.

Referring back to FIG. 1, it can be seen that the mast 14 is received by and contained within the mounting bracket 38. Mounting bracket 38 has sufficient structural stability to retain the mast 14 in an upwardly vertical position relative to the top surface of the upper platform 24 of rotatable table 12. Mast 14 is a tubular member having a plurality of vertically spaced holes 50 extending therethrough. A closure 52 is secured so as to cover the top of the tubular member/mast 14.

Crossbar 16 is connected to mast 14 so as to be in a position parallel to the upper platform 24. Crossbar 16, in use, ideally has height corresponding to the location of the knees of the invalid patient. Crossbar 16 is adjustably connected to the mast 14 and extends outwardly transverse to the longitudinal axis of mast 14. The crossbar 16 is adjustable along the longitudinal axis of the mast. This longitudinal adjustment is accomplished by the inclusion of a cylindrical member 54. Cylindrical member 54 has an inner diameter that is greater than the outer diameter of mast 14. This cylindrical member 54 is suitable for sliding over the exterior of the mast 14. The cylindrical member 54 has a vertical longitudinal axis. The crossbar mechanism 16 also includes a locking mechanism 56 for attaching the cylindrical shaft 54 in juxtaposition to the mast 14. The outwardly extending crossbar is affixed by welding, forming, or other means to the exterior of the cylindrical shaft 54. The crossbar extends radially outwardly from the cylindrical shaft 54. The locking mechanism 56 comprises a pin which extends through an opening in the cylindrical shaft 54 and engages one of the holes 50 in the mast 14. The insertion of this pin locks the crossbar arrangement 16 in position for proper use.

The leg abutment members 18 and 20 are configured for receiving the legs of a patient. The leg abutment member 18 is a padded member that is affixed adjacent on one end of the crossbar 16. The leg abutment 20 is another padded member that is affixed to the other end of the crossbar 16. The purpose of these leg abutment members is to offer a suitable and comfortable mechanism for the receipt of the knees of the patient. By offering a stop to the movement of the knees, the health care worker is better able to lift the patient, to be described hereinafter.

Figure 2:
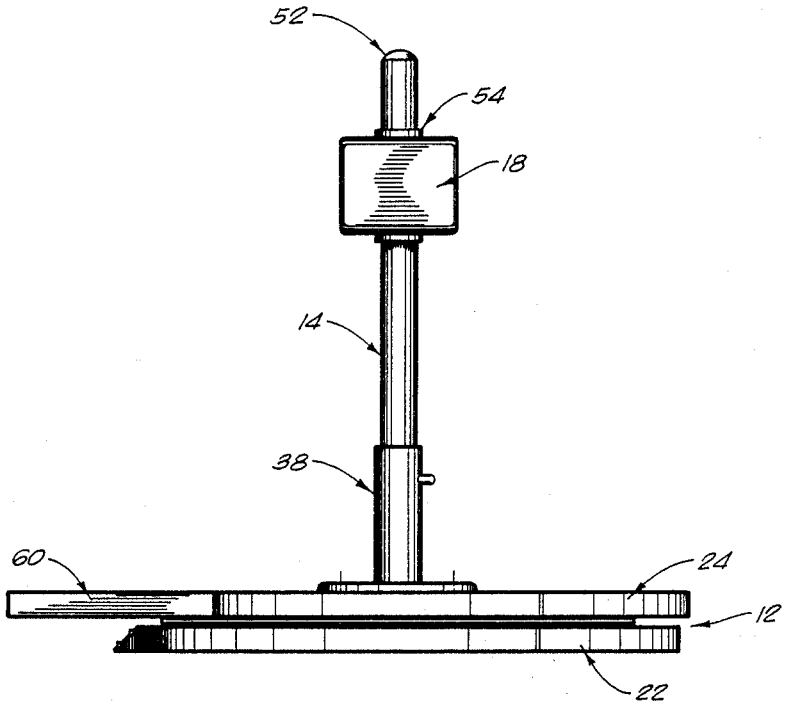
FIG. 2 shows the side view of the patient transfer apparatus of the present invention.

Referring to FIG. 2 shows a side view of the prepared embodiment of FIG. 1. Of particular interest, illustrated in FIG. 2, is the configuration of the upper platform 24 with respect to the lower platform 22. It can be seen that the upper platform 24 is elongated outwardly at 60. This elongation 60 is for the proper placement of the feet of the patient. This affords a greater area for proper foot location and assists in the movement of the patient. It can be also seen in FIG. 2 that the leg abutment member 18 has a thickness greater than the diameter of the crossbar 16 and/or the mast 14.

Figure 3:
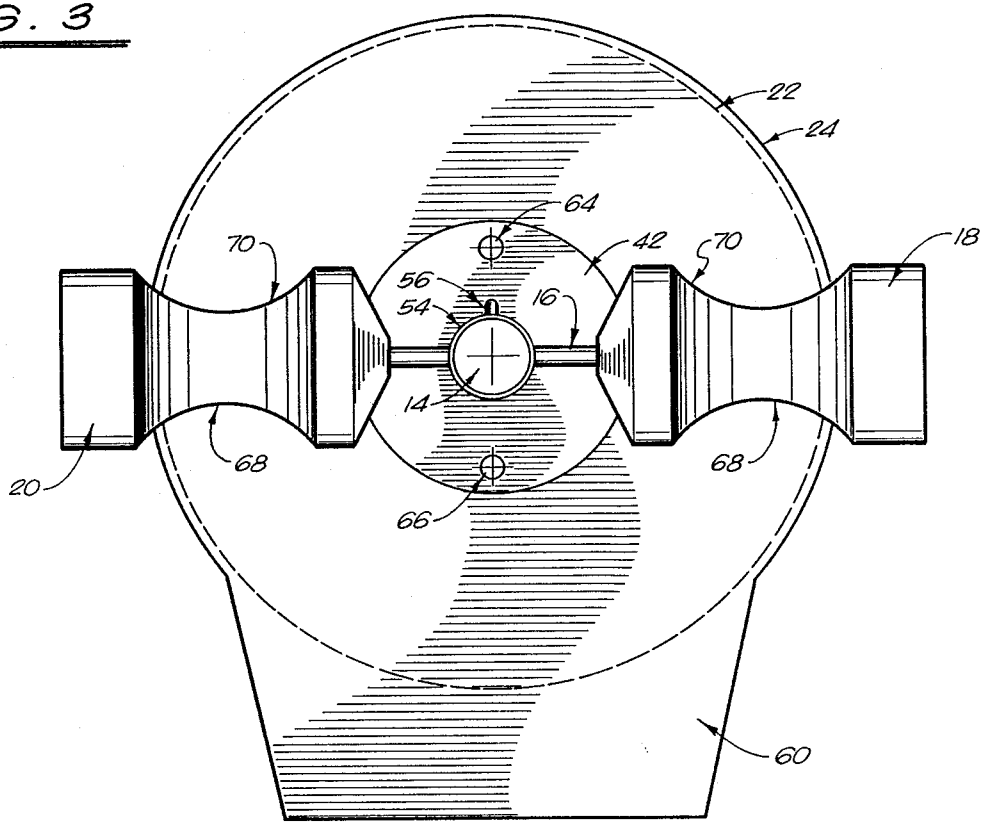
FIG. 3 is a top view showing the patient transfer apparatus of the present invention.

FIG. 3 shows a top view of the patient transfer apparatus of the present invention. Initially, it can be seen that the upper platform 24 has a generally semi-circular configuration. An elongated portion 60 extends outwardly from this generally semi-circular configuration of the upper platform. The lower platform 22 is illustrated with dotted line 62. As can be seen in FIG. 3, the lower platform 22 has a surface area less than the surface area of the upper platform 24. It can be seen that the mounting plate 42 is attached by threaded members 64 and 66 to the upper platform 24. The mast 14 extends upwardly from the center of the circular lower platform 22 and the upper platform 24. It can be seen that the cylindrical member 54 surrounds the exterior of mast 14. Locking mechanism/pin 56 extends through corresponding and aligned sets of vertically spaced holes. Pin 56 serves to fix the position of the crossbar 16 with respect to the mast 14. The first padded member 18 and the second padded member 20 extend outwardly from the crossbar 16.

The shape of the padded members 18 and 20 is particularly illustrated in FIG. 3. It can be seen that the first and second padded members each has a first indentation 68 and a second indentation 70. The first indentation 68 is formed on the side of the padded members 18 and 20 adjacent the elongated portion 60 of the upper platform 24. This indentation 68 has a radius suitable for receiving the leg of a patient. In particular, it is desirable to place the leg, adjacent the knee, of the patient, into the area defined by indentation 68. The indentation 70 formed on the padded members 18 and 20 is suitable for the receipt of the legs of the health care worker. The second indentation 70 is formed on the other side of the padded members 18 and 20. Preferably, these indentations have approximately a three and a half inch recess for receiving the knees of the patient and of the health care worker. This is done so as to eliminate knee side travel with respect to the padded members 18 and 20.

Figure 4:
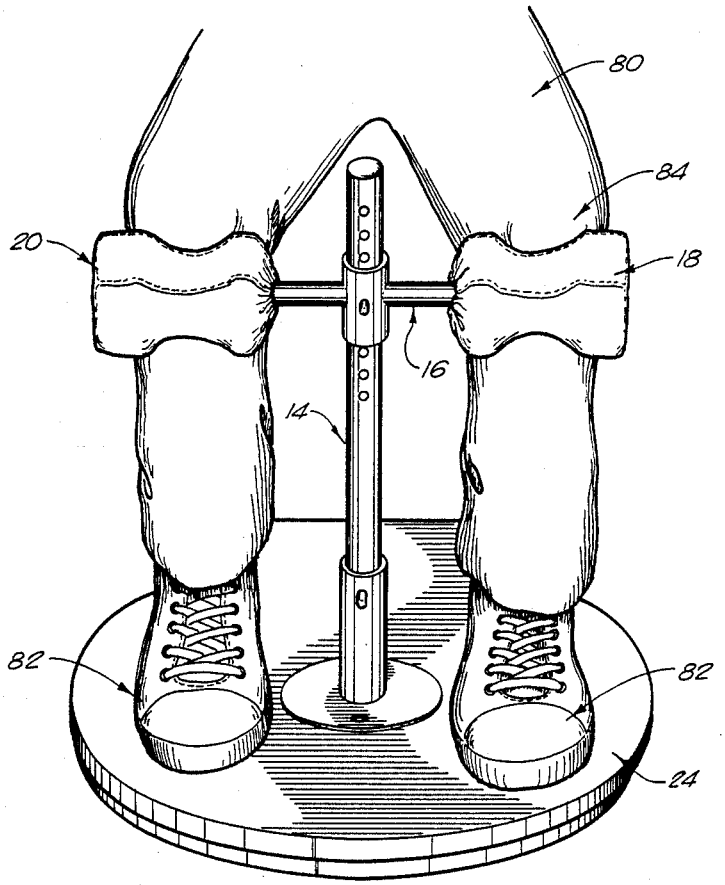
FIG. 4 is a perspective view showing the patient transfer apparatus of the present invention as used in the initial transfer of the patient.

FIG. 4 shows the initial stage of the operation of the present invention. It can be seen in FIG. 4 that the invalid patient 80 initially has his feet placed on the top surface of the upper platform 24. Feet 82 may be positioned by the health care worker by moving the feet 82 from the wheelchair, or from the normal sitting position onto the upper surface of upper platform 24. The invalid patient 80 is then moved forward so as to cause the knees 84 to abut the indentation 68 on the padded members 18 and 20. Padded members 18 and 20 are rigidly retained in place by the positioning of the crossbar 16 with respect to the mast 14.

Figure 5:
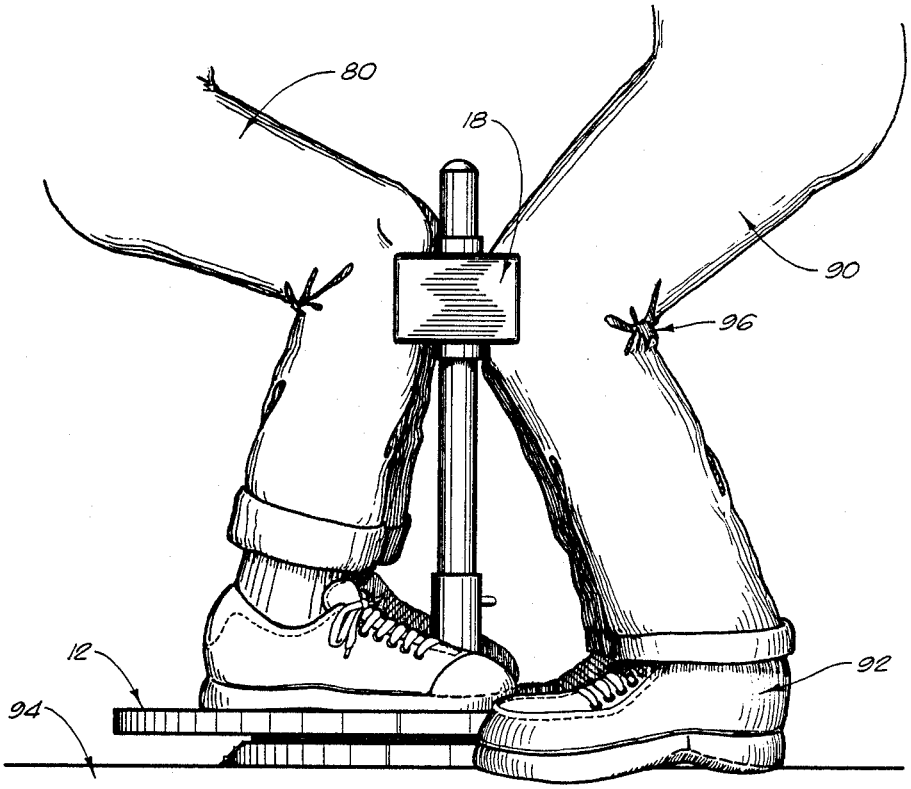
FIG. 5 is a side view of the operation of the patient transfer apparatus of the present invention.

Following this initial position, patient 80 is lifted using the arrangement illustrated in FIG. 5. In particular, the therapist/health care professional 90 is in front of the patient 80. The feet 92 of therapist 90 are placed firmly on floor 94. The knees 96 of the therapist 90 will abut the indentation 70 on the padded members 18 and 20. This leverage, and the fixing of the knees of the invalid patient 80, allows the therapist to more easily lift the patient from the sitting position to the standing position. Once the therapist has the patient standing, the therapist 80 then only has to control the balance of the upper part of the patients body. In this position, the device can then be rotated with the patient 80 since the lower surface of the lower platform 22 is fixed to the floor 94. This allows the patient to be rotated from the wheelchair to the bed. Once the patient is in position adjacent the bed, the therapist can easily release the patient or otherwise lower the patient to the bed's surface.

It is important to the configuration of the present invention that the leg abutment members 18 and 20 be adjusted to the proper height of the knees of the patient. In past techniques of transferring patients, it has been found that it is important to control the movement of the knees. Without a fixing of the knees, it becomes difficult to pull the patient into a standing position. In addition, during the process of lifting, the feet of the patient may become crossed. This further complicates efforts to control and to properly move the patient. As a result, the crossbar 16 of the present invention is adjustable to different heights by adjusting the spring tensioned stop pin of the present invention. The present invention also restrains lateral movement of the knees so as to prevent the patient's feet from crossing.

Another feature of the present invention is that the present invention is suitable for use with patients having new knee or hip prosthetises. In this technique, the health care worker simply places the legs over the top of the crossbar 16 or over the curved indentations in the leg abutment members 18 and 20. With the legs placed over the top of the crossbar 16, the health care professional is then able to use the same technique as described herein previously to transfer the patient from the wheelchair to the bed.

The present invention has a variety of applications in the hospital environment. The present invention is suitable for use with one-legged transfers. The present invention offers a proper amount of leverage that allows for ease of patient transfer. Without the present invention, it is difficult to transfer the patient. And as a result, back injuries, stresses, and strains would otherwise occur to the health care professional. The present invention is relatively simple to manufacture, inexpensive to produce, and easy to utilize. The patient can easily be maneuvered and transfered using the mechanism of the present invention. Following use, the apparatus of the present invention can be easily stored by being broken down into three separate pieces. The particular configuration of the Teflon bearings allows for continual and reliable use of the present invention. The difficulties in ball-bearing operation are avoided by the configuration of the present invention.

The foregoing disclosure and description of the invention is illustrative and explanatory thereof and various changes in the details of the present invention, and in the details of the operation of the present invention, may be made within the scope of the appended claims without departing from the true spirit of the invention. The present invention should be limited only by the following claims and their legal equivalents.

I claim:

1. A patient transfer apparatus comprising:

a lower platform;

an upper platform rotatable relative to said lower platform;

a mast extending upward, perpendicular to the surface of said upper platform;

a crossbar adjustably connected to said mast, said crossbar parallel to said upper platform; and leg abutment means fashioned generally at the ends of said crossbar, said leg abutment means adapted to receive the lower legs of a patient.

2. The apparatus of claim 1, said lower platform having a generally a flat upper surface and a flat lower surface, said lower platform having a surface area less than the surface area of said upper platform.

3. The apparatus of claim 2, said flat lower surface of said lower platform having a plurality of suction areas formed thereon for engaging an abutting surface.

4. The apparatus of claim 1, further comprising:

a plurality of Teflon gaskets interposed between said lower platform and said upper platform, said Teflon gaskets permitting rotational movement of said upper platform relative to said lower platform.

5. The apparatus of claim 1, said mast being a tubular member fixedly mounted at one end to the surface of said upper platform, said mast having a plurality of vertically spaced holes extending therethrough.

6. The apparatus of claim 5, said crossbar further comprising:

a cylindrical shaft having an inner diameter greater than the outer diameter of said tubular member, said cylindrical shaft having a vertical longitudinal axis; and locking means for attaching said cylindrical shaft in fixed relation to said mast.

7. The apparatus of claim 6, said crossbar fixedly attached to the exterior of said cylindrical shaft, said crossbar extending radially outwardly from said cylindrical shaft.

8. The apparatus of claim 6, said locking means comprising:

a pin extending through an opening in said cylindrical shaft and engaging a hole extending through said tubular member.

9. The apparatus of claim 1, said leg abutment means comprising:

a first padded member affixed to one end of said crossbar; and a second padded member affixed to the other end of said crossbar, said first and second padded members for receiving the legs of a patient.

10. The apparatus of claim 9, each of said first and second padded members comprising:

a first indentation formed on one side of said padded member having a radius suitable for receiving the leg of a patient; and a second indentation formed on the other side of said padded member having a radius suitable for receiving the leg of another person.

11. A patient transfer apparatus comprising:

rotatable table means;

a mast fixedly attached to said rotatable table means and extending longitudinally upwardly therefrom;

a crossbar adjustably connected to said mast, said crossbar extending transverse to the longitudinal axis of said mast, said crossbar adjustable along the longitudinal axis of said mast;

a leg abutment means fastened to said crossbar, said leg abutment means having padded surfaces for receiving the lower legs of a patient.

12. The apparatus of claim 11, said rotatable table means comprising:

a lower platform; and an upper platform rotatably connected to said lower platform, said lower platform having a plurality of suction areas formed on the bottom surface of said lower platform, said upper platform having a flat upper surface.

13. The apparatus of claim 12, said rotatable table means further comprising:

a plurality of Teflon gaskets interposed between said lower platform and said upper platform, said Teflon gaskets allowing rotational movement between said upper and lower platforms.

14. The apparatus of claim 12, said upper platform having an elongated portion extending outwardly from a generally semi-circular portion of said upper platform, said lower platform having a surface area less than the surface area of said upper platform.

15. The apparatus of claim 11, said mast having a plurality of vertically spaced holes extending therethrough, said crossbar having an opening of proper location for matching an aligned set of said vertically spaced holes, said crossbar further comprising:

a pin extending through said opening on said crossbar and engaging said aligned set of vertically spaced holes, said pin for fixing the position of said crossbar with respect to said mast.

16. The apparatus of claim 11, said leg abutment means comprising:

a first padded member affixed to one end of said crossbar; and a second padded member affixed to the other end of said crossbar, said first and second padded members for receiving the legs of a patient.

17. A method of enabling a worker to transfer an invalid patient from a wheelchair to a bed comprising the steps of:

placing the feet of said invalid patient onto the upper surface of a rotatable table;

pulling said invalid patient forward until the knees of said invalid patient abut a crossbar extending parallel to and above said rotatable table;

rotating said patient and said rotatable table until the back of said patient is adjacent to said bed; and releasing said patient such that said patient moves backwardly onto said bed.

18. The method of claim 17, further comprising the step of:

adjusting said crossbar to a distance from said rotatable table corresponding to the feet-to-knee height of said patient.

19. The method of claim 17, further comprising the step of:

fastening said rotatable table to the floor between the location of said wheelchair and said bed, said rotatable table comprising an upper platform and a lower platform, said lower platform fastened to said floor, said upper platform rotatable relative to said lower platform.

20. The method of claim 17, further comprising the step of:

placing the knees of said worker against said crossbar on the opposite side of said crossbar from the knees of said patient.

* * * * *